US006837768B2

(12) United States Patent
Kawasaki

(10) Patent No.: US 6,837,768 B2
(45) Date of Patent: Jan. 4, 2005

(54) METHOD OF FABRICATING ELECTRON SOURCE SUBSTRATE AND IMAGE FORMING APPARATUS

(75) Inventor: Junji Kawasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 10/086,562

(22) Filed: Mar. 4, 2002

(65) Prior Publication Data

US 2002/0137423 A1 Sep. 26, 2002

(30) Foreign Application Priority Data

Mar. 5, 2001 (JP) ..... 2001/059647

(51) Int. Cl.[7] ..... H01J 9/06; H01J 9/10; H01J 9/16; H01J 9/46; H05B 33/10

(52) U.S. Cl. ..... 445/60; 445/3; 445/6; 445/24; 445/25

(58) Field of Search ..... 445/3, 6, 24, 25

(56) References Cited

U.S. PATENT DOCUMENTS 5,622,634 A 4/1997 Noma et al. ..... 216/40
5,785,569 A * 7/1998 Stansbury et al. ..... 445/25
6,169,356 B1 1/2001 Ohnishi et al. ..... 313/495
6,419,539 B1 * 7/2002 Tamura et al. ..... 445/6

FOREIGN PATENT DOCUMENTS

| | | |
|---|---|---|
| JP | 7-235255 | 9/1995 |
| JP | 8-171849 | 7/1996 |
| WO | WO00/14761 | 3/2000 |

* cited by examiner

*Primary Examiner*—Vip Patel
*Assistant Examiner*—Sumati Krishnan
(74) *Attorney, Agent, or Firm*—Fitzpatrick, Cella, Harper & Scinto

(57) ABSTRACT

A method of fabricating an electron source includes the steps of fixing a first sealing member to a substrate disposed with an electroconductive member, the first sealing member surrounding the electroconductive member excepting a portion of the electroconductive member, abutting a chamber on the first sealing member to cover the electroconductive member excepting the portion of the electroconductive member and form a hermetically sealed atmosphere between the substrate and the chamber, supplying power to the portion of the electroconductive member to give part of the electroconductive member covered with the chamber an electron-emitting function, and removing the chamber from the substrate.

25 Claims, 6 Drawing Sheets

METHOD OF FABRICATING ELECTRON SOURCE SUBSTRATE AND IMAGE FORMING APPARATUS

BACKGROUND OF THE INVENTION

1. Field of the Invention

The present invention relates to a method of fabricating an electron source substrate by subjecting electroconductive members to an energization forming operation to provide the electroconductive members with an electron-emitting function, to a method of fabricating an image forming apparatus by utilizing the electron source substrate fabricating method, to a system for fabricating an electron source substrate, and to an energization forming method for electroconductive members.

2. Related Background Art

Electron-emitting devices are roughly classified into two types, thermal electron-emitting devices and cold cathode electron-emitting devices. As cold cathode electron-emitting devices, there are metal/insulator/metal electron-emitting devices, surface conduction electron-emitting devices and the like.

A surface conduction electron-emitting device utilizes the phenomenon that electrons are emitted by flowing current through a small area of a thin film formed on a substrate, along a direction in parallel to the film surface.

The assignee of the present invention has submitted various proposals of a surface conduction electron-emitting device having a novel structure and its applications. The fundamental structure and fabricating method are disclosed, for example, in Japanese Patent Application Nos. 7-235255, 8-171849 and the like.

A surface conduction electron-emitting device has an electroconductive film with a partial, electron-emitting region connected to a pair of opposing device electrodes formed on a substrate. A fissure is formed in the partial electron-emitting region of the electroconductive film. Deposition films having as their main composition at least one of carbon and carbon compound at both ends of the fissure.

A plurality of such electron-emitting devices are disposed on a substrate and wired so that an electron source substrate having a plurality of surface conduction electron-emitting devices can be fabricated.

By combining the electron source substrate and a phosphor substrate, a display panel of an image forming apparatus can be fabricated.

Conventionally, such an electron source substrate has been fabricated as in the following manners.

According to a first fabricating method, first, an electron source substrate is formed which has a plurality of devices each having an electroconductive film and a pair of device electrodes connected to the electroconductive film, respectively formed on the substrate, the devices being wired together. Next, the formed electron source substrate is placed in a vacuum chamber. After the inside of the vacuum chamber is evacuated, voltage is applied to each device via an external terminal to form a fissure in the electroconductive film of each device (forming a fissure in the electroconductive film of each device is hereinafter called a forming operation). Gas which contains organic material is introduced into the vacuum chamber and voltage is again applied to each device via the external terminal under the atmosphere which contains organic material to thereby depositing carbon or carbon compound near the fissure (depositing carbon or carbon compound near the fissure is hereinafter called an activation operation).

According to the second fabricating method, first, an electron source substrate is formed which has a plurality of devices each having an electroconductive film and a pair of device electrodes connected to the electroconductive film, respectively formed on the substrate, the devices being wired together. Next, the formed electron source substrate is bonded to a phosphor substrate with a support frame being interposed therebetween to form a panel of an image display apparatus. After the inside of the panel is evacuated via an exhaust pipe, voltage is applied to each device via an external terminal to form a fissure in the electroconductive film of each device (a forming operation). Gas which contains organic material is introduced into the panel via the exhaust pipe, and voltage is again applied to each device via the external terminal under the atmosphere which contains organic material to thereby deposit carbon or carbon compound near the fissure (an activation operation).

Although the first and second fabricating methods have been used conventionally, the first fabricating method requires a larger vacuum chamber and an evacuation system of high vacuum particularly when the electron source substrate becomes large.

With the second fabricating method, the space in the panel of an image forming apparatus is very narrow (about several mm in the case of a panel using surface conduction electron-emitting devices). It takes a long time to introduce gas which contains organic material into the space of the panel and to drain the gas.

SUMMARY OF THE INVENTION

It is an object of the invention to provide an electron source substrate fabricating method and system suitable for mass production at a faster fabrication speed, by not using a large vacuum chamber and an evacuation system of high vacuum.

It is another object of the present invention to provide a fabricating method for an image forming apparatus suitable for mass production at a faster fabrication speed, the image forming apparatus hermetically holding in a vacuum state all electron source substrate and a substrate having image forming members such as phosphor.

It is another object of the present invention to provide an energization forming operation of subjecting electroconductive members, for example, members already given a desired function, to a forming operation and an energization operation in order to make the inspection and the like of the function, without using a large vacuum chamber and an evacuation system of high vacuum.

According to one aspect of the invention, there is provided a method of fabricating an electron source comprising the steps of: fixing a first sealing member to a substrate disposed with an electroconductive member, the first sealing member surrounding the electroconductive member excepting a portion of the electroconductive member; abutting a chamber on the first sealing member to cover tho electroconductive member excepting the portion of the electroconductive member and form a hermetically sealed atmosphere between the substrate and the chamber; supplying power to the portion of the electroconductive member to give part of the electroconductive member covered with the chamber an electron-emitting function; and removing the chamber front the substrate.

According to another aspect of the invention, there is provided a system for fabricating an electron source to be used by the fabricating method described above, comprising: means for supporting the substrate disposed with the electroconductive member with an electrostatic chuck; and means for making a predetermined atmosphere in the chamber abutted on the first sealing member.

According to a further aspect of the invention, there is provided a method of fabricating an image forming apparatus including a step of bonding the electron source and a substrate disposed with image forming members, wherein: the electron source is fabricated by the fabricating method described above.

According to a still further aspect of the invention, there is provided a method of supplying power to electroconductive members, comprising the steps of: fixing a first sealing member to a substrate disposed with the electroconductive members, the first sealing member surrounding the electroconductive members excepting portions of the electroconductive members; abutting a chamber on the first sealing member to cover the electroconductive members excepting the portions of the electroconductive members and form a hermetically sealed atmosphere between the substrate and the chamber; supplying power to the portions of the electroconductive members; and removing the chamber from the substrate.

DETAILED DESCRIPTION OF THE PREFERRED EMBODIMENTS

Figure 1A:
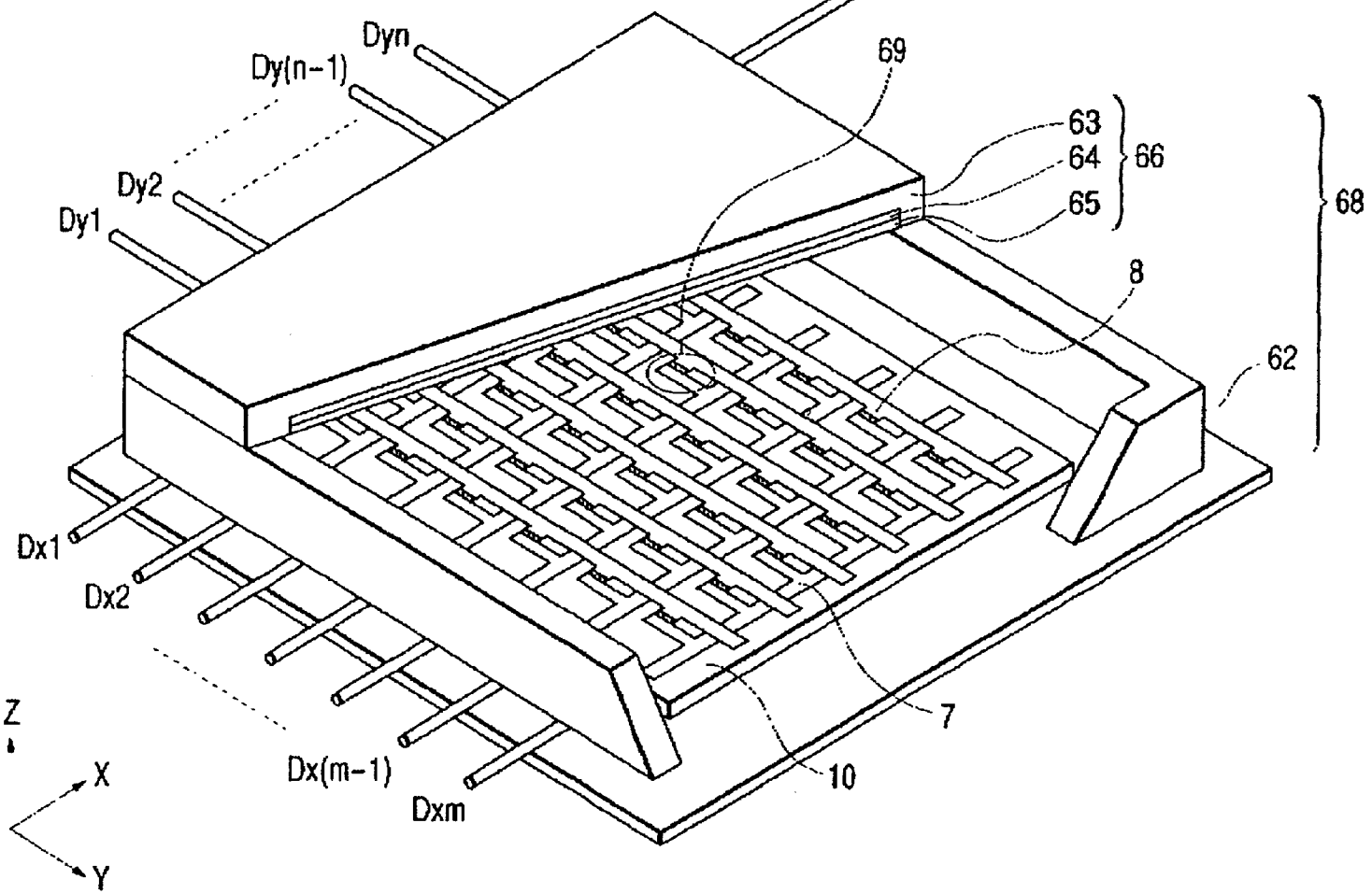
FIG. 1A is a partially broken perspective view showing an example of the structure of an image forming apparatus according to the invention.

The invention provides a method of fabricating an electron source comprising the steps of: fixing a first sealing member to a substrate disposed with an electroconductive member, the first sealing member surrounding the electroconductive member excepting a portion of the electroconductive member; abutting a chamber on the first sealing member to cover the electroconductive member excepting the portion of the electroconductive member and form a hermetically sealed atmosphere between the substrate and the chamber; supplying power to the portion of the electroconductive member to give part of the electroconductive member covered with the chamber an electron-emitting function; and removing the chamber from the substrate.

In preferred embodiments of the electron source fabricating method, "the electroconductive member, includes wiring lines and an electroconductive film with an electron-emitting area connected to the wiring lines", "a plurality of electroconductive films are formed", "the plurality of electroconductive, films are interconnected in a matrix shape by the wiring lines", "the power supplying step is performed in a low pressure atmosphere", "the power supplying stop is performed in a reducing gas atmosphere", "the reducing gas is hydrogen", "the power supplying step is performed in an atmosphere which contains organic material", "the power supplying step includes a first power supplying step to be performed in a reducing gas atmosphere and a second power supplying step to be performed in an atmosphere which contains organic material", "the chamber has a gas inlet port and a gas exhaust port", "the first sealing member is frit glass", "the first sealing member includes adhesive and a support frame bonded to the substrate with adhesive", "the adhesive is frit glass", "the adhesive is indium or its alloy", "a second sealing member is interposed between the first sealing member and the chamber", or "the second sealing member is made of organic elastic material".

The invention provides a method of fabricating an image forming apparatus including a step of bonding the electron source and a substrate disposed with image forming members, wherein: the electron source is fabricated by the electron source fabricating method.

In preferred embodiments of the image forming apparatus fabricating method, "the bonding step uses a third sealing member", "the method comprises a cleaning step of cleaning the first sealing member before the bonding step, by dismounting the chamber from the substrate of the electron source", "the cleaning step uses MEK (methyl-ethyl-ketone) ", "the cleaning step uses HFE (hydro-fluoro-ether)", "the cleaning step uses MEK (methyl-ethyl-ketone) and HFE (hydro-fluoro-ether)", or "the bonding step of bonding the electron source and the substrate disposed with image forming members, is performed on the first sealing member".

The invention provides a system for fabricating an electron source to be used by the electron source fabricating method, comprising: means for supporting the substrate disposed with the electroconductive member with an electrostatic chuck; and means for making a predetermined atmosphere in the chamber abutted on the first sealing member.

The invention provides a method of supplying power to electroconductive members, comprising the steps of: fixing a first sealing member to a substrate disposed with the electroconductive members, the first sealing member surrounding the electroconductive members excepting portions of the electroconductive members; abutting a chamber on the first sealing member to cover the electroconductive members excepting the portions of the electroconductive members and form a hermetically sealed atmosphere between the substrate and the chamber; supplying power to the portions of the electroconductive members; and removing the chamber from the substrate.

In preferred embodiments of the electron source power supplying method, "a second sealing member is disposed in an area where the chamber is abutted on the first scaling member", "a portion of each electroconductive member covered with the chamber has an electron-emitting function, and the electron-function is inspected by emitting electrons by supplying power to the electroconductive member" or "the power supply is performed in a low pressure atmosphere".

Next, preferred embodiments of the invention will be described.

With an electron source substrate fabricating method of the invention, electroconductive members disposed on a substrate are subjected to an energization forming operation under an air-tight atmosphere to give a partial region of each electroconductive member an electron-emitting function to thereby form an electron-emitting device.

An electron-emitting device applicable to the invention is preferably a surface conduction electron-emitting device described earlier. In the following therefore, a surface conduction electron-emitting device is used by way of example.

Figure 4A:
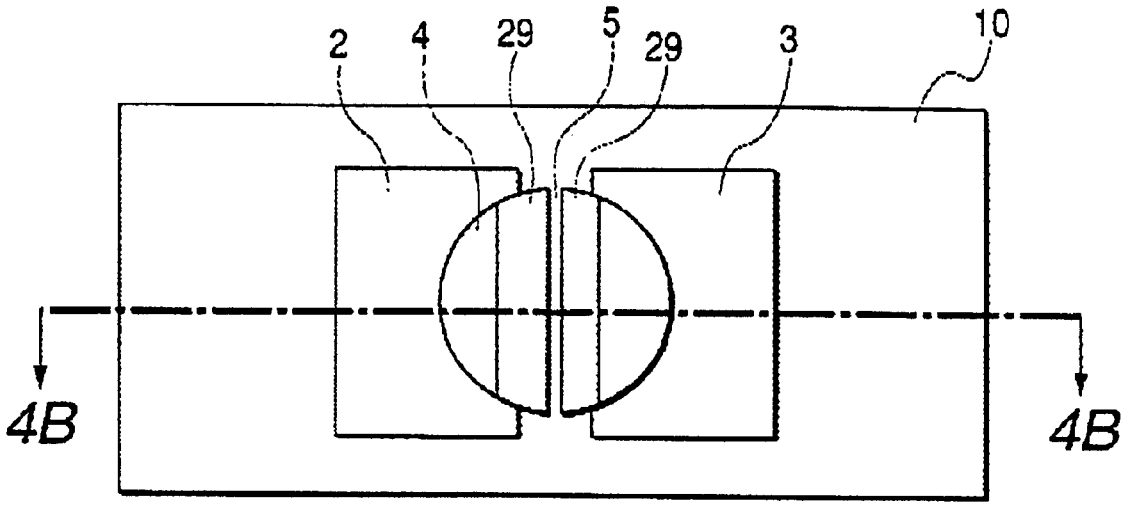
FIG. 4A is a plane view showing air example of the structure of an electron-emitting device according to the invention.
Figure 4B:
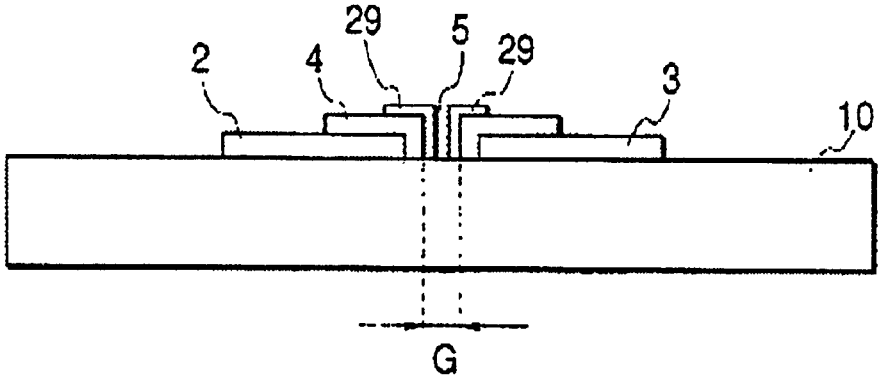
FIG. 4B is a cross sectional view thereof.

If a surface conduction electron-emitting device is formed by subjecting an electroconductive member to the energization and forming operation, a device having an electroconductive film between a pair of electrodes may be used as the electroconductive member, FIGS. 4A and 4B are schematic diagrams showing an example of the structure of a surface conduction electron-emitting device applicable to the invention. FIG. 4A is a plan view and FIG. 4B is a cross sectional view taken along a plane 4B—4B shown in FIG. 4A. Referring to FIGS. 4A and 4B, reference numeral 10 represents a substrate (base body), reference numerals 2 and 3 represent electrodes (device electrodes), reference numeral 4 represents an electroconductive film, reference numeral 29 represents a carbon film, reference numeral 5 represents a gap of the carbon film 29, and reference character G represents a gap of the electroconductive film 4.

The material of the substrate 10 may be quartz glass, glass with reduced impurities such as Na, soda lime glass, a lamination of soda lime glass and $SiO_2$ sputtered thereon, ceramic such as alumina, an Si substrate or the like.

As the material of the opposing device electrodes 2 and 3, general electroconductive materials can be Used. For example, such an electroconductive material is selected from: printed electroconductive material constituted of metal or its alloy such as Ni, Cr, Au, Mo, W, Pt, Ti, Al, Cu and Pd and metal or metal oxide such as Pd, Ag, Au, $RuO_2$ and Pd—Ag, glass and the like; transparent electroconductive material such as $In_2O_3$—$SnO_2$; semiconductor electroconductive material such as polysilicon; and the like.

The gap between device electrodes, device electrode length, the width and thickness of the electroconductive film 4 and the like are designed by considering the application field and the like. The device electrode gap is preferably in the range from several hundreds nm to several hundreds $\mu$m, and more preferably in the range from several $\mu$m to several tens $\mu$m by considering the voltage applied between the device electrodes and the like.

The device electrode length is in the range from several $\mu$m to several hundreds $\mu$m by considering the electrode resistance and the electron-emitting characteristics. The thickness of the device electrode is in the range from several tens nm to several $\mu$m In addition to the structure shown in FIG. 4, a lamination structure of an electroconductive film 4 and opposing device electrodes stacked in this order on a substrate 10 may also be used.

The material of the electroconductive, film 4 may be: metal such as Pd, Pt, Ru, Ag, Au, Ti, In, Cu, Cr, Fe, Zn, Sn, Ta, W and Pb; oxide such as PdO, $SnO_2$, $In_3O_3$, PbO and $Sb_2O_3$; boride such as $HfB_2$, $ZrB_2$, $LaB_6$, $CeB_6$, $YB_4$, $GdB_4$; carbide such as TiC, ZrC, HFC, TaC, SiC and WC; nitride such as TiN, ZrN and HfN; semiconductor such as Si, Ge; and carbon.

It is preferable to use as the electroconductive film 4 a film made of fine particles in order to obtain good electron-emitting characteristics. The thickness of the electroconductive film 4 is selected properly by considering the step coverage of the device electrodes 2 and 3, the resistance value between the device electrodes 2 and 3, the forming operation condition to be later described, and the like. The thickness of the electroconductive film 4 is preferably several angstroms to several hundreds nm so that the resistance Rs thereof takes a value of $10^2$ to $10^7$ Ω/□. The resistance Rs is equal to a resistance R=Rs (l/w) of a thin film having a width w and a length l as measured along its longitudinal direction. The film thickness taking such a resistance is in a range from 5 nm to 50 nm. In this film thickness range, each thin film is in the form of a fine particle film. The fine particle film is a film made of a set of a plurality of fine particles. The micro structure of the fine particle film takes not only the state that fine particles are independently dispersed but also the state that fine particles are disposed near each other or they are superposed upon each other (including the state that several fine particles are collected to form an island structure as a whole). The diameter of each fine particle is in the range from several angstroms to several hundred nm, or preferably in the range from 1 nm to 20 nm.

An example of the fabricating method for the surface conduction electron-emitting device having the structure shown in FIGS. 4A and 4B will be described.

1) After the substrate 10 is washed sufficiently by cleaning agent, pure water, organic solvent or the like, device electrode material is deposited by vacuum deposition, sputtering or the like. Device electrode 2 and 3 are formed on the substrate 10, for example, by photolithography techniques.

2) On the substrate 10 formed with the device electrodes 2 and 3, organic metal solution is coated to form an organic metal film. As the organic metal solution, organic compound solution may be used which contains metal of the material of the electroconductive film 4 as its main elements. The organic metal film is subjected to a thermal baking process and then patterned by lift-off, etching or the like to thereby form the electroconductive film 4 made of metal oxide. Although an organic metal solution coating method is used, the method of forming the electroconductive film 4 is not limited only thereto. For example, vacuum deposition, sputtering, chemical vapor deposition, dispersion coating, dipping, spinner and the like may also be used.

3) Next, the forming process is executed, electric power is applied from an unrepresented power source between the device electrodes 2 and 3. The electroconductive film 4 is therefore locally broken, deformed, or decomposed and changes its structure to form the gap G.

Voltage to be applied to the device for the forming process is a pulse voltage. The shape of pulse voltage may be a triangle pulse having a constant peak value, or a triangle pulse having a gradually increasing peak value.

A completion of the forming process can be detected by measuring current flowing through the device when a voltage pulse is applied between adjacent pulses to such an extent that the electroconductive film 4 is not broken, deformed or decomposed. It is preferable to stop the forming process when the resistance value exceeds 1 MΩ calculated by applying a voltage of about 0.1 V to the device and measuring the current.

This forming process is preferably executed in an atmosphere which contains reducing material.

If the electroconductive film 4 is made of metal oxide, the effective reducing material may be $H_2$ and CO as well as organic material gas such as methane, ethane, ethylene, propylene, benzene, toluene, methanol, ethanol, and acetone. This may be described to an occurrence of aggregation when the material of the electroconductive film changes from metal oxide to metal through reduction. If the electroconductive film 4 is made of metal, aggregation by reduction does not occur so that CO and acetone do no present the effect of promoting aggregation. However, also in this case, $H_2$ presents the effect of promoting aggregation.

4) The device subjected to the forming process is preferably subjected to a process called an energization process. With the energization process, a device current $I_f$ and an emission current $I_e$ change considerably.

For example, the energization process may be performed by repetitively applying a pulse to the device in an atmosphere which contains organic material gas. This atmosphere may be formed by utilizing gas left in an atmosphere when the inside of a vacuum chamber is degassed by a oil diffusion pump or a rotary pump. Alternatively, the atmosphere nay be formed by introducing proper organic material gas into a vacuum chamber after it is evacuated sufficiently by an ion pump or the like. The pressure of organic material gas is determined properly since the preferable pressure becomes different basing upon the application type, the vacuum chamber shape arid organic material kind and the like. A proper organic material may be: aliphatic hydrocarbon and aromatic hydrocarbon of alkane, alkene and alkyne; alcohol; aldehyde; ketone; amine; organic acid such as phenol, carboxylic acid and sulfonic acid; and the like. More specifically, a proper organic material may be saturated hydrocarbon expressed by $C_nH_{2n+2}$ such as methane, ethane and propane, unsaturated hydrocarbon expressed by $C_nH_{2n}$ such as ethylene and propylene, benzene, toluene, methanol, ethanol, formaldehyde, acetoaldehyde, acetone, methylethylketone, methylamine, ethylamine, phenol, benzonitrile, acetonitrile and the like.

With this energization process, the carbon film 29 made of carbon or carbon compound is formed on the substrate 10 exposed in the gap G and its nearby area, the carbon or carbon compound being made of organic material in the atmosphere. The device current $I_f$ and emission current $I_e$ change considerably.

A completion of the energization process can be determined by measuring the device current $I_f$ and emission current $I_n$. The pulse width, duration and peak value are selected properly.

Carbon and carbon compound may be graphite (including HOPG, PG and GC. HOPG has a nearly perfect graphite crystal structure. PG has a crystal structure somewhat disturbed, with a crystal grain of about 20 nm. GC has a crystal structure disturbed more, with a crystal grain of about 2 nm), amorphous carbon (including amorphous carbon arid a mixture of amorphous carbon and graphite fine crystals), and hydrocarbon (compound expressed by $C_mH_n$ including compound which contains another element such as N, O and Cl). The thickness of the carbon film 29 is preferably in the range of not thicker than 50 nm, and more preferably in the range of not thicker than 30 nm.

By performing the above-described energization forming operation, a device having the electroconductive film 4 between a pair of device electrodes 2 and 3 becomes a surface conduction electron-emitting device.

By disposing a plurality of such devices on a substrate, the electron source substrate of the invention can be fabricated, and the image forming apparatus of the invention can be fabricated by using such an electron source substrate.

Next, the invention will be described by using as an example an image forming apparatus such as shown in FIG. 1A. FIG. 1A is a partially broken perspective view schematically showing an image forming apparatus (display panel,) 68.

In FIG. 1A, reference numeral 7 represents X-direction wiring lines, reference numeral 8 represents Y-direction wiring lines, reference numeral 10 represents an electron source substrate, reference numeral 69 represents electron-emitting devices such as shown in FIG. 4, reference numeral 62 represents a support frame, reference numeral 66 represents a face plate constituted of a glass substrate 63, a metal back 64 and phosphor 65, reference numeral 67 represents a high voltage terminal, and reference symbols Dxl to Dxm and Dyl to Dyn represent external terminals.

First, the fabricating system and processes of an electron source substrate according to the invention will be described.

Figure 2:
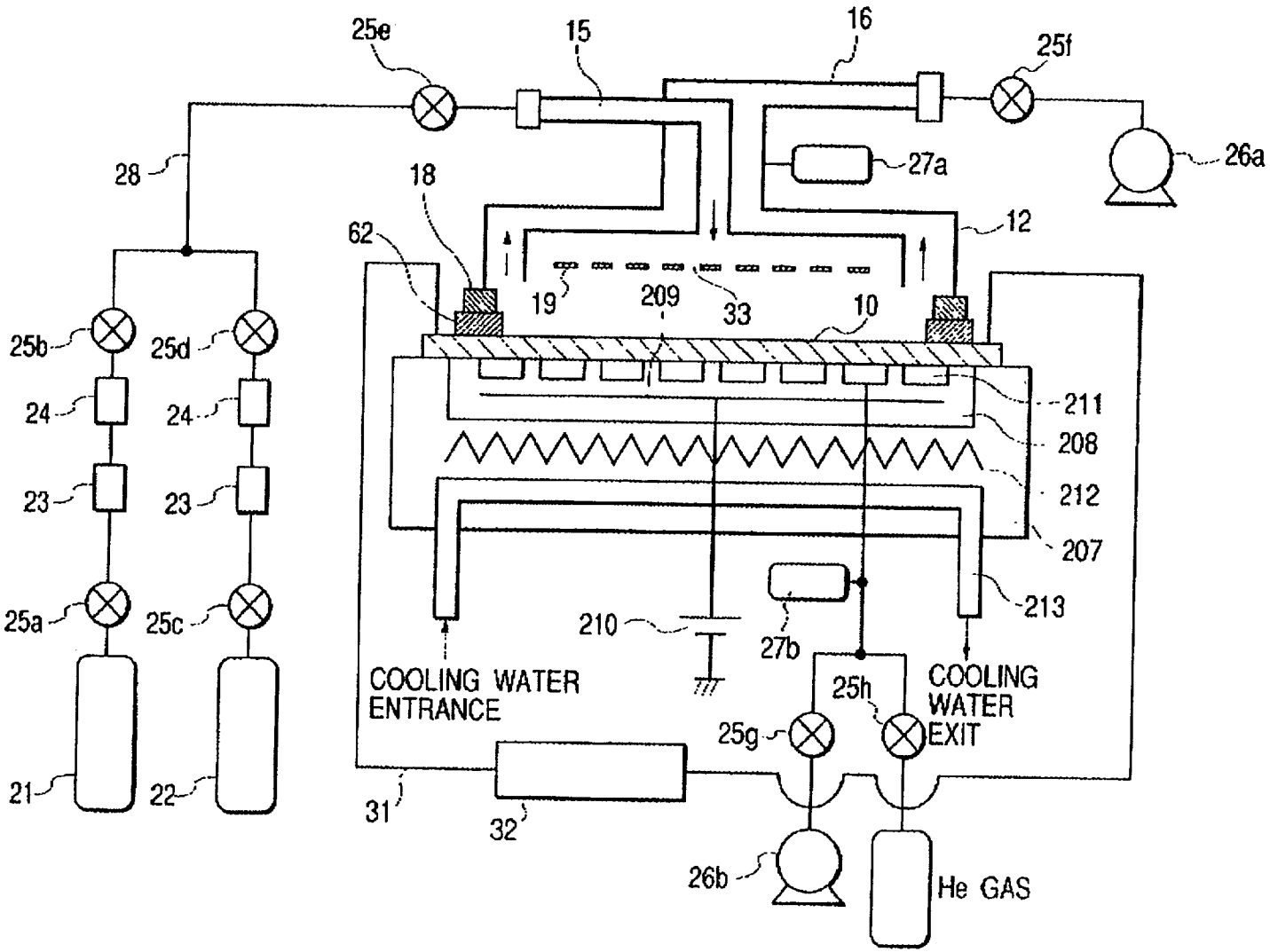
FIG. 2 is a schematic diagram in cross section showing an example of the structure of an electron source substrate fabricating system according to the invention.
Figure 3:
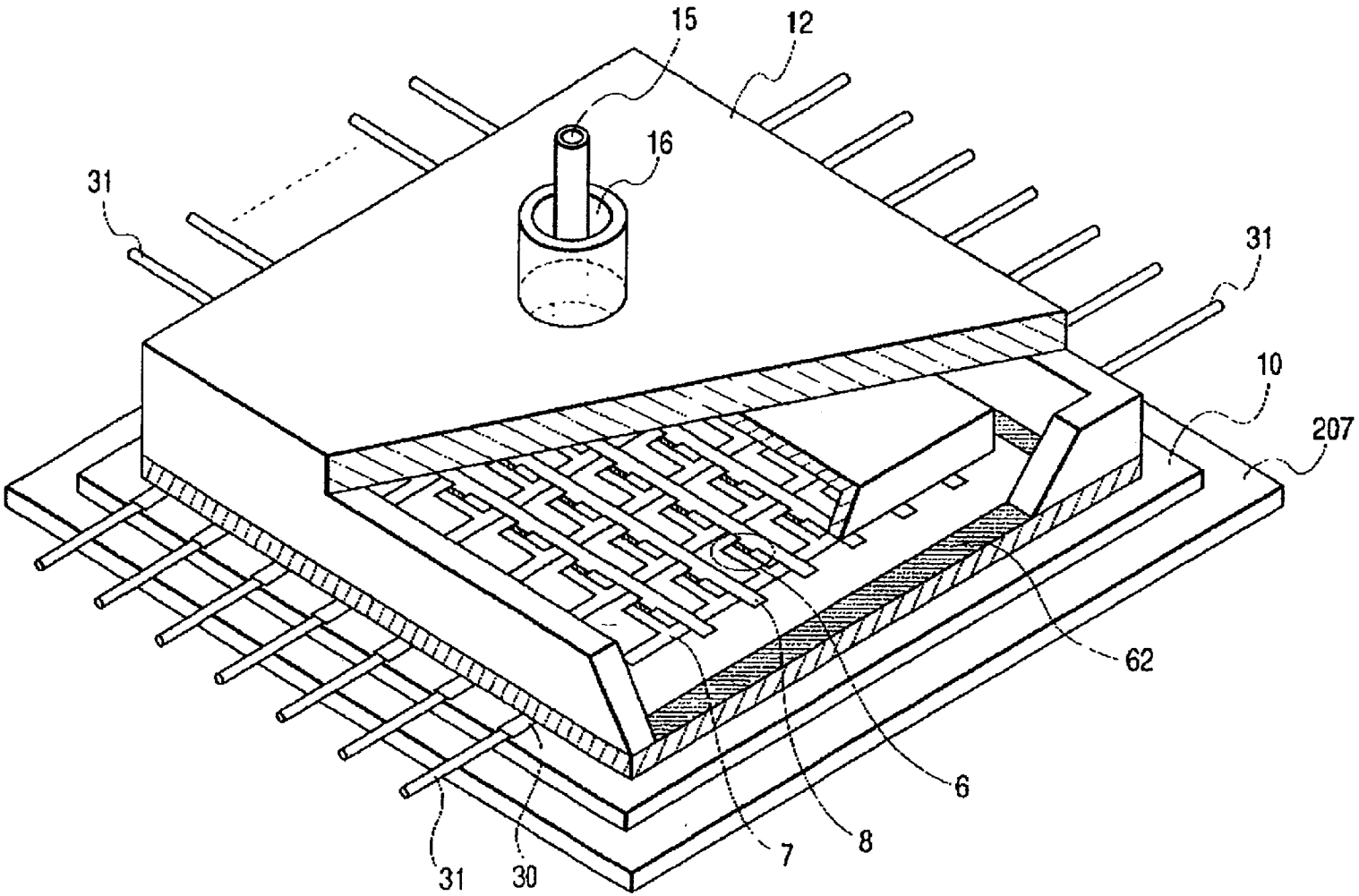
FIG. 3 is a perspective view of the electron source substrate shown in the system of FIG. 2, the peripheral area of the substrate being partially broken.

FIGS. 2 and 3 are diagrams showing an electron source substrate fabricating system. FIG. 2 is a schematic diagram showing the overall structure of the fabricating system, and FIG. 3 is a partially broken perspective view showing the peripheral area of an electron source substrate. In FIGS. 2 and 3, identical reference numerals to those shown in FIG. 1A indicate similar components. In FIGS. 2 and 3, reference numeral 6 as, electroconductive member to be later formed as an electron-emitting device, reference numeral 12 represents a vacuum chamber, reference numeral 15 represents a gas inlet port, reference numeral 16 represents an exhaust port, reference numeral 18 represents a second vacuum sealing member, reference numeral 19 represents a diffusion plate, reference numeral 21 represents hydrogen gas or organic material gas, reference numeral 22 represents carrier gas, reference numeral 23 represents a moisture filter, reference numeral 24 represents a gas flow controller, reference symbols 25*a* to 25*h* represent a valve, reference symbols 26*a* and 26*b* represent a vacuum pump, reference symbols 27*a* and 27*b* represent a vacuum meter:, reference numeral 28 represents a pipe, reference numeral 30 represents a lead wire, reference numeral 32 represents a driver made of a power source and a current controller, reference numeral 31 represents a wiring line interconnecting the lead wire 30 of the electron source substrate and the driver 32, reference numeral 33 represents an opening of the diffusion plate 19, reference numeral 62 represents a support frame, and reference numeral 207 represents a substrate holder as means for holding the electron source substrate.

The substrate holder 207 has an electrostatic chuck 208. The electron source substrate 10 is sucked and fixed to the substrate holder 207 by an Electrostatic force of the electrostatic chuck 208 generated when voltage is applied between an electrode 209 in the electrostatic chuck 208 and the electron source substrate 10.

In order to set the potential of the electron source substrate 10 to a predetermined value, an electroconductive member such as an ITO film is formed on the bottom surface of the substrate.

In order to stick the electron source substrate 10 by electrostatic chucking, it is necessary that the distance between the electrode 209 and electron source substrate 10 is short. It is desired to push the electron source substrate 10 once to the electrostatic chuck 208 by another method.

In the system shown in FIG. 2, air in a groove 211 formed in the surface of the electrostatic chuck 208 is exhausted to push the electron source substrate 10 to the electrostatic chuck by atmospheric air, and then a high voltage is applied from the high voltage source 210 to the electrode 209 to sufficiently chuck the electron source substrate. Even if air in the vacuum chamber 12 is exhausted at a later process, a pressure difference applied to the electron source substrate 10 is cancelled by the electrostatic force of the electrostatic chuck 208 so that deformation and breakage of the electron source substrate 10 can be prevented. In order to increase thermal conduction between the electrostatic chuck 208 and electron source substrate 10, it is desired to introduce heat exchange gas in the groove 211 once exhausted. This gas is preferably He although other gas may be, used. By introducing heat exchange gas, thermal conduction between the electron source substrate 10 and electrostatic chuck 208 is possible via the groove 211, Even in the area without the groove 211, thermal conduction becomes larger than the case that the electron source substrate, 10 and electrostatic chuck 208 are in thermal contact by mere mechanical contact. The whole thermal conduction can therefore be improved considerably. Therefore, during the energization forming operation, heat generated in the electron source substrate 10 can move easily to the substrate holder 207 via the electrostatic chuck 208. It is therefore possible to suppress a temperature rise of the electron source substrate 10 and a temperature distribution to be caused by localized heat generation. By providing the substrate holder with temperature control means such as a heater 212 and a cooling unit 213, the temperature of the electron source substrate 10 can be controlled more precisely.

Organic material of the gas 21 may be the organic material used by the energization process for the electron-emitting device, or a mixture of the organic material diluted with nitrogen, helium or argon. During the forming process, in order to promote the formation of a fissure in the electroconductive member 6, a reducing hydrogen gas or the like may be introduced into the vacuum chamber 12. When different gas is to be introduced, a proper system is coupled to the inlet pipe 28 of the vacuum chamber 12 by using the valve 25*e* and the like.

The organic material gas 21 can be used directly if the organic material is in a gas state at a room temperature. If the organic material is in a liquid or solid state at a room temperature, it is evaporated or sublimated in a vessel to use it. The evaporate or sublimated gas may be, mixed with dilution gas. Carrier gas 22 is inert gas such as nitrogen, argon and helium.

The organic material gas 21 and carrier gas 22 are mixed at a predetermined ratio and introduced into the vacuum chamber 12. The flow rates and mixture ratio of the gasses are controlled by the gas flow controller 24. The gas flow controller 24 is constituted of a mass flow controller, electromagnetic valves and the like. After the mixture gas is heated, if necessary, to a proper temperature by an unrepresented heater mounted around the pipe 28, it is introduced via the inlet port 15 into the vacuum chamber 12. The temperature of the mixture gas is preferably set to the same temperature as that of the electron source substrate 10.

It is preferable to mount the moisture filter 23 at the intermediate of the pipe 28 to remove moisture in the introduced gas. As the material of the moisture filter 23, absorbent such as silica gel, molecular sheave, and magnesium hydroxide may be used.

The mixture gas introduced into the vacuum chamber 12 is exhausted at a constant exhaustion speed by the vacuum pump 26 via the exhaust port 16 so that the pressure of the mixture gas in the vacuum chamber 12 can be maintained constant. The vacuum pump 26*a* is a low vacuum pump such as a dry pump, a diaphragm pump and a scroll pump. An oil free pump is preferably used in the prevent invention.

The lead electrodes 30 disposed on the electron source substrate 10 are positioned outside the vacuum chamber 12, and connected to the wiring lines 31 via TAB wires, probes or the like to be connected to the driver 32.

The device energization process can be performed by applying a pulse voltage via the wiring line 31, to each electroconductive member 6 on the electron source substrate 10 by using the driver while the mixture gas which contains organic material is flowed into the vacuum chamber 12.

In the electron source substrate fabricating method of the invention using the above-described system, the forming process, energization process and the like can be performed in the following manner. A first sealing member is fixed surrounding the electroconductive members disposed on the electron source substrate 10 (including the electroconductive members 6 to be later formed as electron-emitting devices, X- and Y-direction wiring lines 7 and 8 made of electroconductive material, and lead electrodes 30) excepting the lead electrodes 30. The vacuum chamber is abutted on the first scaling member to cover the electroconductive members excepting the lead electrodes and form a hermetically sealed atmosphere between the electron source substrate 10 and vacuum chamber 12.

The first sealing member is constituted of adhesive and the support frame adhered to the electron source substrate with adhesive. In order to fill irregular surfaces of the electron source substrate formed by the lead electrodes 30 and ensure the hermetically sealed atmosphere, the adhesive is preferably frit glass, indium or its alloy. According to the invention, frit glass itself may be used as the first sealing member without using the support frame 62.

It is preferable that the upper surface of the support frame 62 is planarized. By contacting the vacuum chamber 12 on the planarized support frame, an air tightness in the chamber can be ensured. In this case, it is preferable that as shown in FIG. 2 the second sealing member 18 is disposed between the support frame 62 and chamber 12. The air tightness can therefore be improved further and a more reliable air tightness state can be realized.

The second sealing member 18 is adhered to the support frame 62 mounted on the electron source substrate 10 in order to ensure the air tightness of the chamber 12. The second sealing member is preferably made of organic elastic material. As such organic elastic material, fluorine rubber is preferable which is relatively thermally stable.

In the electron source substrate fabricating system and method described above, since the chamber 12 is required to cover at least the electroconductive members 6 on the electron source substrate 10, the system can be made compact. Since the lead electrodes 30 of the electron source substrate 10 are positioned outside the chamber, electrical connection between the electron source substrate and power source (driver) can be made easily. After the energization and forming process, the fabricated electron source substrate 10 can be easily dismounted from the chamber 12.

In the image forming apparatus fabricating method of the invention, the electron source substrate is formed in the manner described above, and the electron source substrate and the face plate 66 formed with an image forming member (phosphor 65) are bonded together (bonding process). More specifically, after the forming process and energization process for the electron source substrate 10, the chamber 12 is dismounted from the electron source substrate 10. Then, the electron source substrate 10 and face plate 66 are bonded together by using a third sealing member. In this case, bonding the electron source substrate 10 and face plate 66 is preferably performed on the support frame 62 and it is preferable to perform a process (cleaning process) of removing the composition of the second sealing member 18 attached to the support frame 62. The composition attached to the support frame surface adversely affects the drawing performance of the third sealing member (particularly indium) at a later process. It may become impossible to uniformly draw the third sealing member on the support frame, which may results in leak at the bonding area between the electron source substrate 10 and face plate 66 with the third sealing member.

If frit glass itself is used as the first sealing member without using the support frame 662, the above-described bonding process can be performed without using the third sealing member.

In the cleaning process, it is preferable to use, for example, MEK (methyl-ethyl-ketone) and/or HFE (hydro-fluoro-ether). By using this material, the organic elastic composition such as fluorine rubber attached to the support frame surface can be fully wiped out.

The third sealing member is preferably frit glass, indium or its alloy.

The image forming apparatus fabricated in the above manner can maintain a stable hermetically sealed state and form an image of good quality.

Next, the energization forming method for the electro-conductive member according to the invention will be described.

As described earlier, the energization forming method used by the electron source substrate fabricating method of the invention, is suitable not only for the electron source substrate fabricating processes but also for the case that the energization forming method is required to be performed for electroconductive members in a hermetically sealed atmosphere in order to inspect the already given function of the electroconductive members. For example, if the electron-emitting characteristics of an electron source substrate can be inspected easily before the electron source substrate fabricated by the electron source substrate fabricating method of the invention is assembled to an image forming apparatus, and even if some components of the electron source substrate are defective, it is possible to prevent other components constituting the image forming apparatus from being dumped The energization forming method for electroconductive members according to the invention will be described by using the electron source substrate, shown in FIG. 3 as an example. On the first sealing member (support frame) 62 being fixed surrounding the electroconductive members (including the electroconductive members 6 already given an electron-emitting function, X- and Y-direction wiring lines 7 and 8 made of electroconductive material, and lead electrodes 30) excepting the lead electrodes 30, a vessel is abutted to cover the electroconductive members excepting the lead electrodes 30 and form a hermetically sealed atmosphere between the electron source substrate 10 and vessel. A predetermined drive voltage is applied to each electroconductive member 6 via the lead electrode 30 so that the electron-emitting function of each electroconductive member 6 can be inspected. The vessel may be a vessel having therein an acceleration electrode for accelerating electrons and phosphor, like the face plate 66 formed with the image forming member (phosphor 65) shown in FIG. 1A.

In the energization forming method for electroconductive members of this invention, this method can be performed for the electroconductive members in a desired atmosphere without using a large vacuum chamber and a high vacuum evacuation system. After the energization forming method, the vessel is dismounted from the substrate (sample) so that the sample can be picked up easily.

(Embodiments)

Embodiments of the electron source substrate and the image forming apparatus fabricating method according to the invention will be described in detail with reference to the accompanying drawings.

(First Embodiment)

Figure 5:
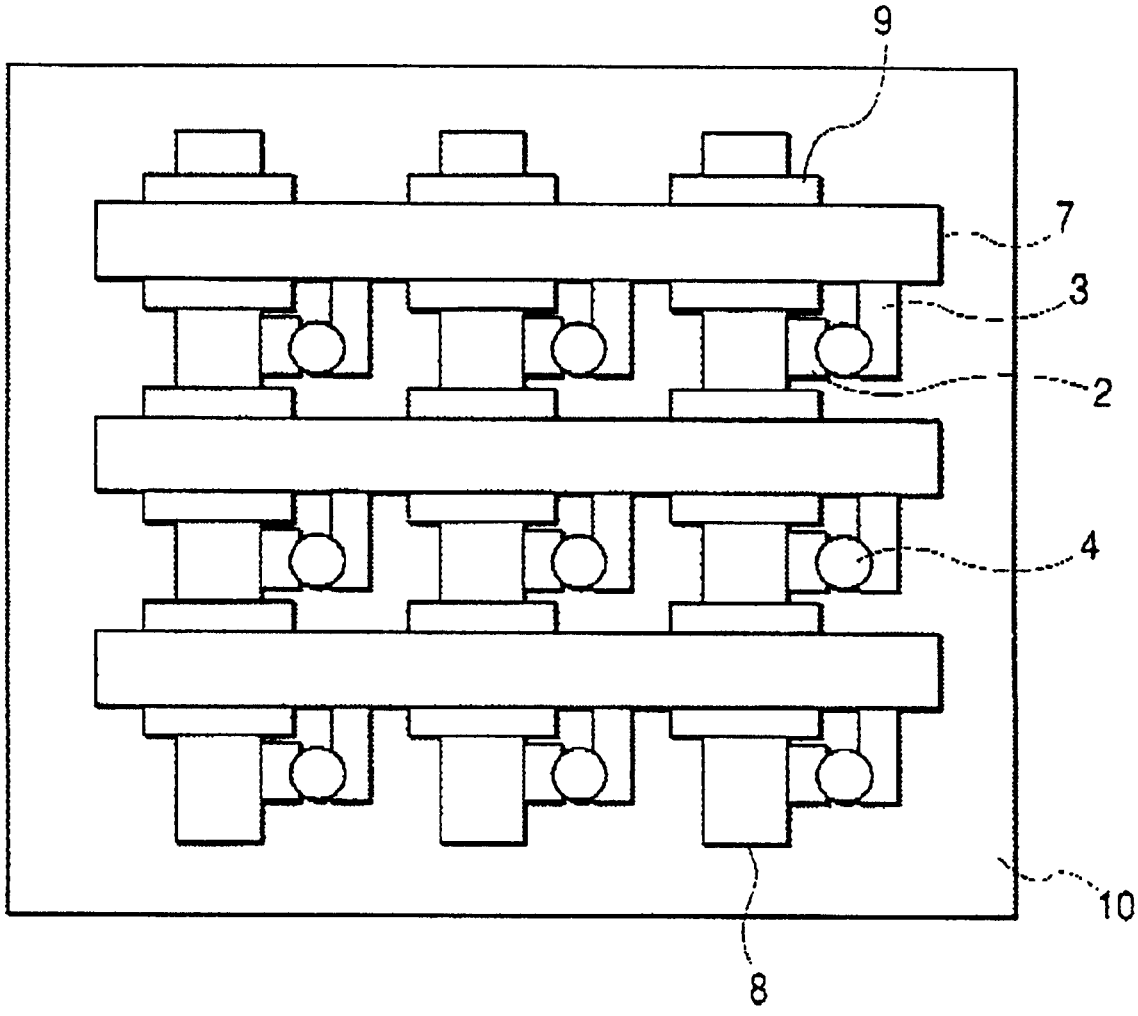
FIG. 5 is a plan view illustrating an electron source substrate fabricating method according to the invention.

In this embodiment, an electron source substrate having a number of electroconductive films of a simple matrix connection such as FIG. 5 was fabricated, and after the energization forming operation for giving the electroconductive films an electron-emitting function was performed, an image forming apparatus such as shown in FIG. 1A was fabricated by using the electron source substrate.

First, the electron source substrate fabricating method will be described with reference to FIGS. 2 to 5.

On a glass substrate (size: 350×300 mm, thickness: 5 mm) formed with an $SiO_2$ film, Pt paste was printed by offset printing, heated and baked to from device electrodes 2 and 3 having a thickness of 50 nm such as shown in FIG. 5. Ag paste was printed by screen printing, heated and baked to form X-direction wiring lines 7 (240 lines) and Y-direction wiring lines 8 (720 lines). On the cross area between the X-land Y-direction wiring lines 7 and 8, insulating paste was printed by screen printing, and heated and baked to form insulating layers 9.

Next, palladium complex solution was dropped between the device electrodes 2 and 3 by using an jetting apparatus, of a bubble jet type, and heated for 30 minutes at 350° C. to form an electroconductive film 4 shown in FIG. 5 and made of fine particles of palladium oxide. The thickness of the electroconductive film 4 was 20 nm. With the above processes, an electron source substrate 10 was fabricated which has a plurality of electroconductive members each having a pair of device electrodes 2 and 3 and the electro-conductive film 4 connected by the X- and Y-direction wiring lines 7 and 8 in a matrix pattern.

Next, as shown in FIGS. 2 and 3, a support frame 62 was mounted on the electron source substrate 10. First, frit glass was drawn with a dispenser on an area of the electron source substrate 10 where the support frame is mounted, dried for 10 minutes at 120° C., and thereafter baked preliminary for 10 minutes at 360° C. Thereafter, the support frame 62 was placed on the frit glass and baked for 30 minutes at 420° C. under pressure to adhere it to the electron source substrate 10.

Warp and swell of the electron source substrate were observed. The electron source substrate had a warp of about 0.5 mm in the peripheral area relative to the central area because of the original warp and swell of the electron source substrate and the warp and swell formed by the heat treatments described above.

Next, the electron source substrate 10 with the support frame 62 was fixed to the substrate holder 207 of the fabricating system shown in FIG. 2. More specifically, air in the groove 211 formed in the surface of the electrostatic chuck 208 was exhausted to push the electron source substrate 10 to the electrostatic chuck by atmospheric pressure. A high voltage was applied to the electrode 209 from the high voltage power source 210 to reliably chuck the electron source substrate 10. Thereafter, He gas was introduced to 10 hPa in order to increase, thermal conduction between the electrostatic chuck 208 and electron source substrate 10.

The temperature of the electron source substrate 10 was set to 85° C. by the heater 212 in the substrate holder.

Thereafter, the chamber 12 was made in contact with the support frame 62 on the electron source substrate 10 via the second sealing member 18 made of fluorine rubber (product name: Viton (Registered Trademark)).

Next, the valve 25*f* on the exhaust port side was opened and the inside of the chamber 12 was evacuated by the vacuum pump 26. Thereafter, voltage was applied between the device electrodes 2 and 3 of each electroconductive member 6 (constituted of the device electrodes 2 and 3 and electroconductive film 4) via the X- and Y-direction wiring Lines 7 and 8 by using the driver 32 connected to the lead wires 30 via wiring lines 31 shown in FIG. 3, to thereby perform the forming process for the electroconductive films 4 and form the gap G such as shown in FIGS. 4A and 4B in each electroconductive film 4.

Next, the energization process was performed by using the same fabricating system. Tolunitrile as the source material of carbon was introduced into the chamber 12 via a slow leak valve and the pressure was maintained at $1.3\times10^{-4}$ Pa. A voltage was applied between the device electrode 2 and 3 of each electroconductive member 6 via the X- and Y-direction wiring lines 7 and 8 by using the driver, 32 to perform the energization process. The power supply was stopped when the emission current $I_e$ reaches near saturation after about 60 minutes, and the slow leak valve was closed to terminate the energization process.

With the above processes, the carbon film 29 such as shown in FIGS. 4A and 4B were deposited on each electroconductive member to form an electron-emitting device.

Next, an electron-emitting function of the electron source substrate fabricated by using the above-described fabricating system and processes was inspected.

This inspection method was performed by using the fabricating system shown in FIG. 2.

First, the fabricated electron source substrate 10 was fixed to the substrate holder 207 of the fabricating system shown in FIG. 2 by using the electrostatic chuck.

Thereafter, instead of the chamber shown in FIG. 2, a vessel was made in contact with the support frame 62 on the, electron source substrate 10 via the second sealing member 18 made of fluorine rubber (product name: Viton). The vessel had therein an acceleration electrode for accelerating electrons emitted from each electron source on the electron source substrate 10 and phosphor which emits light when accelerated electrons are bombarded.

Next, the hermetically sealed atmosphere between the electron source substrate 10 and vessel was evacuated to form a predetermined low pressure atmosphere. A voltage of 5 kV was applied to the acceleration electrode in the vessel, and a drive voltage was applied between the device electrodes 2 and 3 of each electroconductive member 6 via the X- and Y-direction wiring lines 7 and 8 by using the driver 32 connected to the lead wires 30 via the wires 31 shown in FIG. 3 to thereby inspect the luminance of light-emitting phosphor in order to inspect the electron-emitting function of the fabricated image forming apparatus.

An image forming apparatus such as shown in FIG. 1A was fabricated by using the electron source substrate inspected in the above manner.

Figure 1B:
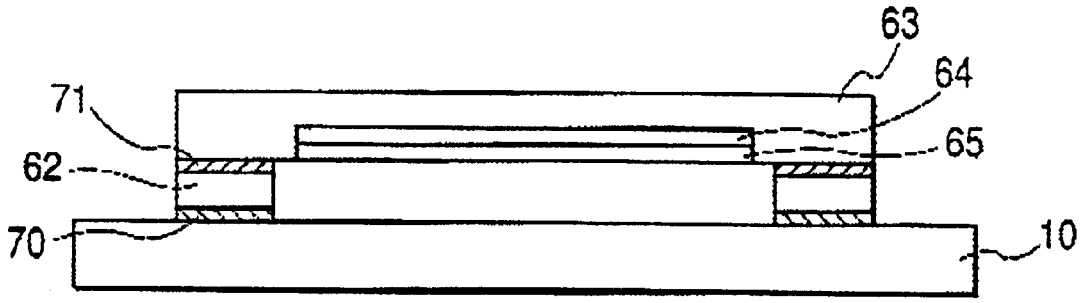
FIGS. 1B and 1C are cross sectional views of the image forming apparatus.

FIG. 1A conceptually shows the image forming apparatus and FIG. 1B is a cross sectional view along a X-direction. In FIG. 1B, reference numeral 70 represents frit glass used for fixing the electron source substrate 10 to the support frame 62.

First, frit glass (third sealing member) 71 was drawn on the support frame 62 with a dispenser, and thereafter the electron source substrate 10 and face plate 66 were placed in n vacuum chamber to bond them together at 380° C. under a vacuum condition and obtain the image forming apparatus (panel) 68.

The inside of the image forming apparatus was evacuated via an unrepresented exhaust pipe mounted on the face plate 66 to make the inner pressure lower than the atmospheric pressure. Thereafter, the exhaust pipe was sealed and a getter process was performed by a high frequency heating method by using an unrepresented getter material in the apparatus in order to maintain the inner pressure at the time of sealing.

In order to prevent the apparatus from being broken by the atmospheric pressure even if the inner pressure of the apparatus was set lower than the atmospheric pressure, an unrepresented member was mounted on the electron source substrate 10 in order to maintain the space between the electron source substrate 10 and face plate 66.

With the image forming apparatus completed as described above, the vacuum state in the image forming apparatus can be reliably maintained. A scan signal and a modulation signal were applied from unrepresented signal generators to each electron-emitting device via the external terminals Dxl to Dxm and Dyl to Dyn to emit electrons which were accelerated by a high voltage of 5 kV applied to the metal back 65 or unrepresented transparent electrode via the high voltage terminal 67 and bombarded upon the phosphor film 64 which was excited to emit light and display an image. With the image display apparatus of this embodiment, there was no visual variation in luminance and color and an image of good quality sufficient for a television was able to be displayed.

(Second Embodiment)

In this embodiment, an electron source substrate having a number of electroconductive films of a simple matrix connection such as FIG. 5 was fabricated, and after the energization forming operation for giving the electroconductive films an electron-emitting function was performed, an image forming apparatus such as shown in FIG. 1A was fabricated by using the electron source substrate.

Figure 1C:
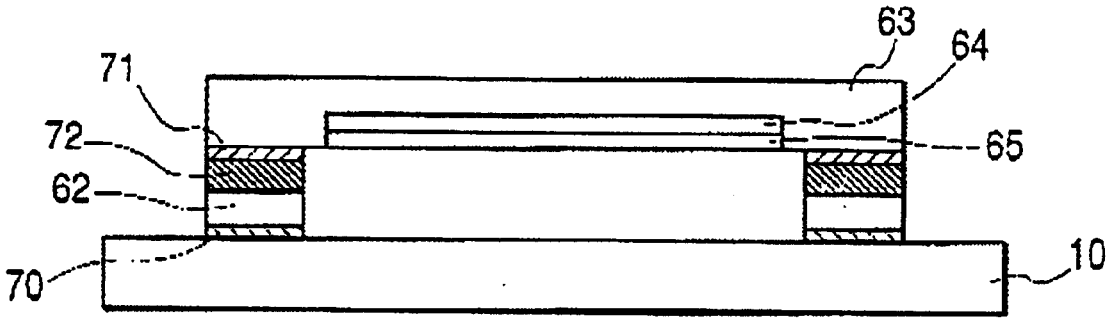

In this embodiment, indium was used as the, third sealing member 71 for bonding together the electron source substrate 10 and face plate 66. As shown in FIG. 1C, the support frame with silver paste 72 wars used in order to improve a drawing performance of indium on the support frame.

The silver paste 72 was printed on the support frame 62 by screen printing and then baked at 580° C. Similar to the first embodiment, the support frame, was bonded to the electron source substrate 10. The energization forming process quite the same as that of the first embodiment excepting the use of the support frame with silver paste was performed to give each electroconductive member the electron-emitting function, and the electron-emitting function of the electron source substrate was inspected in quite the same manner as that of the first embodiment.

Thereafter, the silver paste surface on the support frame 62 was cleaned with HFE (hydro-fluoro-ether) and MEK (methyl-ethyl-ketone) to remove compositions of an O ring and a rubber sheet made of nitrile rubber, silicon rubber, fluorine rubber or the like attached when the scaling member 18 was formed, The compositions attached to the surface of the support frame adversely affect the wettability of indium to be coated at a later process.

Next, indium was drawn on the support frame 62 with an ultrasonic solder iron, and thereafter the electron source substrate 10 and face plate 66 were placed in a vacuum chamber to bond them together at 200° C. under a vacuum condition and obtain the image forming apparatus (panel) 68.

The inside of the image forming apparatus was evacuated visa an unrepresented exhaust pipe mounted on the face plate 66 to make the inner pressure lower than the atmospheric pressure. Thereafter, the exhaust pipe was sealed and a getter process was performed by a high frequency heating method by using an unrepresented getter material in the apparatus in order to maintain the inner pressure at the time of sealing.

In order to prevent the apparatus from being broken by the atmospheric pressure even if the inner pressure of the apparatus was set lower than the atmospheric pressure, an unrepresented member was mounted on the electron source substrate 10 in order to maintain the space between the electron source substrate 10 and face plate 66.

With the image forming apparatus completed as described above, the vacuum state in the image forming apparatus can be reliably maintained. A scale signal and a modulation signal were applied from unrepresented signal generators to each electron-emitting device via the external terminals Dxl to Dxm and Dyl to Dyn to emit electrons which were accelerated by a high voltage of 5 kV applied to the metal back 65 or unrepresented transparent electrode via the high voltage terminal 67 and bombarded upon the phosphor firm 64 which was excited to emit light and display an image. With the image display apparatus of this embodiment, there was no visual variation in luminance and color and an image of good quality sufficient for a television was able to be displayed.

COMPARISON EXAMPLE

An electron source substrate and an image forming apparatus were fabricated in a manner similar to the first and second embodiments, excepting that the energization forming operation was performed by making the chamber 12 in contact with the electron source substrate 10 via the second sealing member 18 made of fluorine rubber (product name: Viton) without disposing the support frame on the electron source substrate 10.

With the image forming apparatus completed as described above, the vacuum state in the chamber 12 was not able to be reliably maintained during the energization forming operation. There was variation in the electron-emitting characteristics of each electron-emitting device and an image of good quality sufficient for a television was unable to be displayed.

As described so far, according to the invention it is possible to provide an electron source substrate fabricating method and system suitable for mass production at a faster fabrication speed, by not using a large vacuum chamber and an evacuation system of high vacuum.

According to the invention, it is possible to provide an electron source substrate fabricating method and a system capable of fabricating an electron source substrate excellent in the electron-emitting characteristics.

According to the invention it is possible to provide a fabricating method for an image forming apparatus suitable for mass production at a faster fabrication speed, the image forming apparatus hermetically holding in a vacuum state an electron source substrate and a substrate having image forming members such as phosphor.

According to the invention it is possible to provide an image forming apparatus capable of forming an image of good quality.

According to the invention it is possible to provide an energization forming operation capable of inspecting the function of electroconductive members, for example, members already given a desired function such as an electron-emitting function, in a optional hermetically sealed atmosphere, without using a large vacuum chamber and an evacuation system of high vacuum.

What is claimed is:

1. A method of fabricating an image display apparatus comprising the steps of:

fixing a first sealing member to a first substrate disposed with an electroconductive member, the first sealing member surrounding the electroconductive member except for a portion of the electroconductive member;

abutting a chamber having a gas inlet port and a gas exhaust port on the first sealing member to cover the electroconductive member except for the portion of the electroconductive member and form a hermetically sealed atmosphere between the first substrate and the chamber;

supplying power to the portion of the electroconductive member to give part of the electroconductive member covered with the chamber an electron-emitting function;

removing the chamber from the first substrate; and bonding the first substrate with a second substrate on which an image forming member is disposed, wherein the bonding is performed on the first sealing member fixed to the first substrate.

2. A method according to claim 1, wherein the electroconductive member includes wiring lines and an electroconductive film with an electron-emitting area connected to the wiring lines.

3. A method according to claim 2, wherein a plurality of electroconductive films are formed.

4. A method according to claim 3, wherein the plurality of electroconductive films are interconnected in a matrix shape by the wiring lines.

5. A method according to claim 1, wherein the step of supplying power is performed in a low pressure atmosphere.

6. A method according to claim 1, wherein the step of supplying power is performed in a reducing gas atmosphere.

7. A method according to claim 6, wherein a reducing gas of the reducing gas atmosphere is hydrogen.

8. A method according to claim 1 wherein the step of supplying power is performed in an atmosphere which contains organic material.

9. A method according to claim 1, wherein the step of supplying power includes a first power supplying step to be performed in a reducing gas atmosphere and a second power supplying step to be performed in an atmosphere which contains organic material.

10. A method according to claim 1, wherein the first sealing member is frit glass.

11. A method according to claim 1, wherein the first sealing member includes adhesive and a support frame bonded to the substrate with adhesive.

12. A method according to claim 11, wherein the adhesive is frit glass.

13. A method according to claim 11, wherein the adhesive is indium or its alloy.

14. A method according to claim 1, wherein a second sealing member is interposed between the first sealing member and the chamber.

15. A method according to claim 14, wherein the second sealing member is made of organic elastic material.

16. A method according to claim 1, wherein the bonding step uses a third sealing member.

17. A method according to claim 16, wherein the third sealing member is an adhesive.

18. A method according to claim 17, wherein the adhesive is frit glass.

19. A method according to claim 17, wherein the adhesive is indium or its alloy.

20. A system for fabricating an electron source to be used by the method according to any one of claims 1–9 and 10–15, comprising:

means for supporting the substrate disposed with the electroconductive member with an electrostatic chuck; and means for making a predetermined atmosphere in the chamber abutted on the first sealing member.

21. A system according to claim 20, further comprising means for supplying power to the electroconductive member.

22. A method of fabricating an image forming apparatus comprising the step of:

bonding an electron source and a substrate disposed with image forming members, wherein the electron source is fabricated by a method comprising the steps of:

fixing a first sealing member to a substrate disposed with an electroconductive member, the first sealing member surrounding the electroconductive member except for a portion of the electroconductive member, abutting a chamber on the first sealing member to cover the electroconductive member except for the portion of the electroconductive member and form a hermetically sealed atmosphere between the substrate and the chamber, supplying power to the portion of the electroconductive member to give part of the electroconductive member covered with the chamber an electron-emitting function, and removing the chamber from the first substrate, wherein the bonding step uses a third sealing member, and further comprising a cleaning step of cleaning the first sealing member before the bonding step, by dismounting the chamber from the substrate of the electron source.

23. A method according to claim 22, wherein the cleaning step uses MEK (methyl-ethyl-ketone).

24. A method according to claim 22, wherein the cleaning step uses HFE (hydro-fluoro-ether).

25. A method according to claim 22, wherein the cleaning step uses MEK (methyl-ethyl-ketone) and HFE (hydro-fluoro-ether).

* * * * *

UNITED STATES PATENT AND TRADEMARK OFFICE

CERTIFICATE OF CORRECTION

PATENT NO. : 6,837,768 B2
APPLICATION NO. : 10/086562
DATED : January 4, 2005
INVENTOR(S) : Junji Kawasaki It is certified that error appears in the above-identified patent and that said Letters Patent is hereby corrected as shown below:

COLUMN 1

Line 41, “and” should read --and/or--.

COLUMN 2

Line 41, “all” should read --an--;
Line 58, “tho” should read --the--; and
Line 63, “front” should read --from--.

COLUMN 3

Line 29, “cross” should read --cross---;
Line 31, “cross section” should read --cross-section--;
Line 38, “air” should read --an--;
Line 40, “cross sectional” should read --cross-sectional--; and
Line 41, “plan” should read --plane--.

COLUMN 4

Line 52, “scaling” should read --sealing--.

COLUMN 5

Line 13, “cross sectional” should read --cross-sectional--;
Line 27, “Used.” should read --used.--;

COLUMN 6

Line 61, “described” should read --ascribed--; and
Line 65, “no” should read --not--.

UNITED STATES PATENT AND TRADEMARK OFFICE

CERTIFICATE OF CORRECTION

PATENT NO. : 6,837,768 B2
APPLICATION NO. : 10/086562
DATED : January 4, 2005
INVENTOR(S) : Junji Kawasaki It is certified that error appears in the above-identified patent and that said Letters Patent is hereby corrected as shown below:

COLUMN 7

Line 9, “a oil” should read --an oil--;
Line 11, “nay” should read --may--;
Line 15, “basing” should read --based--;
Line 16, “arid” should read --and--;
Line 27, “acetonitrile” should read --, and acetonitrile,--;
Line 36, “$I_n$.” should read --$I_e$.--; and
Line 43, “arid” should read --and--.

COLUMN 8

Line 41, “Electrostatic” should read --electrostatic--;
Line 50, “stick” should read --fix--; and
Line 53, “once to” should read --onto--.

COLUMN 9

Line 2, “be, used” should read --be used--;
Line 5, “groove 211,” should read --groove 211.--;
Line 7, “that” should read --in which-- and “substrate,” should read --substrate--;
Line 34, “evaporate” should read --evaporated-- and “may be, mixed” should read -- may be mixed--; and
Line 51, “sheave,” should read --sieve,--.

COLUMN 10

Line 13, “scaling” should read --sealing--.

COLUMN 11

Line 2, “results in leak” should read --result in leaks--;
Line 23, “invention,” should read --invention--;
Line 36, “dumped” should read --discarded.--; and
Line 39, “substrate,” should read --substrate--.

UNITED STATES PATENT AND TRADEMARK OFFICE

CERTIFICATE OF CORRECTION

PATENT NO. : 6,837,768 B2
APPLICATION NO. : 10/086562
DATED : January 4, 2005
INVENTOR(S) : Junji Kawasaki It is certified that error appears in the above-identified patent and that said Letters Patent is hereby corrected as shown below:

COLUMN 12

Line 15, “from” should read --form--; and
Line 58, “hPa” should read --kPa-- and “increase,” should read --increase--.

COLUMN 13

Line 4, “Lines” should read --lines--;
Line 14, “driver,” should read --driver--;
Line 17, “reaches” should read --reached--;
Line 20, “were” should read --was--;
Line 31, “the,” should read --the--;
Line 52, “cross sectional” should read --cross-sectional-- and “a” should read --an--; and
Line 58, “n” should read --a--.

COLUMN 14

Line 27, “the,” should read --the--;
Line 30, “wars” should read --was--;
Line 33,“frame,” should read --frame--;
Line 45, “attached” should read --that attached--;
Line 46, “formed,” should read --formed.--; and
Line 55, “visa” should read --via--.

UNITED STATES PATENT AND TRADEMARK OFFICE

CERTIFICATE OF CORRECTION

PATENT NO. : 6,837,768 B2
APPLICATION NO. : 10/086562
DATED : January 4, 2005
INVENTOR(S) : Junji Kawasaki It is certified that error appears in the above-identified patent and that said Letters Patent is hereby corrected as shown below:

COLUMN 15

Line 8, "firm" should read --film--.

Signed and Sealed this

Fifth Day of December, 2006

JON W. DUDAS
*Director of the United States Patent and Trademark Office*